United States Patent [19]

Conyers et al.

[11] 4,332,632

[45] Jun. 1, 1982

[54] SOLID PROPELLANT COMPOSITION

[75] Inventors: John A. Conyers, Fort Worth, Tex.; Adolph E. Oberth, Fair Oaks; George M. Santerre, Sacramento, both of Calif.

[73] Assignee: The United States of America as represented by the Secretary of the Navy, Washington, D.C.

[21] Appl. No.: 161,364

[22] Filed: Jul. 6, 1971

[51] Int. Cl.[3] ..... C06B 45/10

[52] U.S. Cl. ..... 149/19.2; 149/19.4; 149/20

[58] Field of Search ..... 149/19, 19.2, 19.4, 149/20

[56] References Cited

U.S. PATENT DOCUMENTS 3,245,849 4/1966 Klazer et al. ..... 149/19

3,291,660 12/1966 Oberth et al. ..... 149/19

3,350,245 10/1967 Dickinson ..... 149/19

3,919,011 11/1975 Oberth et al. ..... 149/19.4

4,000,023 12/1976 Oberth et al. ..... 149/19.4

*Primary Examiner*—Edward A. Miller

*Attorney, Agent, or Firm*—R. S. Sciascia; A. L. Branning; T. E. McDonnell

[57] ABSTRACT

A solid rocket propellant comprising (1) ammonium perchlorate, (2) aluminum, (3) poly(1,2-butylene) glycol, (4) the reaction product of propylene oxide and either trimethylolpropane, hexanetriol or mixtures thereof, (5) 2,3-dihydroxypropyl bis(2-cyanoethyl) amine, (6) hexamethylene diisocyanate, (7) copper chromite, (8) a carboxylic acid ester of either a diol and a monocarboxylic acid or a dicarboxylic acid and a monofunctional alcohol, and (9) sulfur and optionally containing (10) a metal acetylacetonate, (11) 2,4-pentanedione and (12) liquid silicon oil.

10 Claims, No Drawings

SOLID PROPELLANT COMPOSITION

BACKGROUND OF THE INVENTION

This invention relates generally to chemical compositions and more specifically to chemical compositions that can be used as rocket propellants.

For certain specialized applications, it is necessary to have a rocket propellant which has good thermal cycling ability so that it will not appreciably deteriorate when exposed to temperature extremes in the range of from about −65° F. to +160° F. Additionally it is important that the rocket propellant be relatively safe, have good storage stability, good ballistic properties, cure rapidly, and be easily processed. Furthermore it is desirable that it be prepared from relatively inexpensive starting materials and that it be readily duplicated.

Over the years research has continually gone on to find rocket propellants which have all the hereinbefore noted properties.

SUMMARY OF THE INVENTION

Accordingly, one object of this invention is to provide a rocket propellant.

Another object of this invention is to provide a rocket propellant which can undergo thermal cycling between about −65° F. and +160° F. without substantial deterioration.

A further object of this invention is to provide a rocket propellant which is relatively safe.

A still further object of this invention is to provide a rocket propellant which has relatively good storage stability.

Another object of this invention is to provide a rocket propellant which has relatively good ballistic properties.

Another object of this invention is to provide a rocket propellant which is rapidly cured.

Still another object of this invention is to provide a rocket propellant which can be easily processed.

A still further object of this invention is to provide a rocket propellant which can readily be duplicated.

Yet another object of this invention is to provide a rocket propellant which is prepared from relatively inexpensive starting materials.

These and other objects of this invention are accomplished by providing a rocket propellant comprising (1) ammonium perchlorate, (2) aluminum, (3) poly(1,2-butylene) glycol, (4) the reaction product of propylene oxide and either trimethylolpropane, hexanetriol or mixtures thereof, (5) 2,3-dihydroxypropyl-bis (2-cyanoethyl) amine, (6) hexamethylene diisocyanate, (7) copper chromite, (8) a carboxylic acid ester of either a diol and a monocarboxylic acid or a dicarboxylic acid and a monofunctional alcohol, and (9) sulfur and optionally containing (10) a metal acetylacetonate, (11) 2,4-pentanedione and (12) liquid silicon oil.

DESCRIPTION OF THE PREFERRED EMBODIMENT

In order to obtain a propellant composition which possesses the desirable properties hereinbefore enumerated, it is necessary to blend the various constituents in a particular ratio. Thus, the ammonium perchlorate, which is the oxidizer of the instant composition, should constitute between about 60–85 weight percent of the total composition. Preferably the ammonium perchlorate is 60/40 mixture of ground rotary dried/unground material but this is not essential.

The aluminum, which is the fuel of the instant composition, should constitute between about 2–26 weight percent. Preferably the particle size is in the range of 40–60 microns but this is not essential.

The organic binder is actually a mixture of four different materials. Thus poly(1,2-butylene) glycol constitutes about 2.5–7.5 weight percent of the composition. Although polymers with a molecular weight range of between about 1600 and 2400 work well, the preferred molecular weight range is about 1900–2100. The binder also includes about 1–4 weight percent of a polyoxypropylene derivative of a triol which is the reaction product of propylene oxide with trimethylolpropane, hexane triol or mixtures thereof. Since the propylene oxide adds to the triol the bulk of the polymer weight actually comprises propoxy units so that the product is completely defined by its molecular weight which is between about 3500 and 4700 with a range of 4000–4210 being preferred. The binder also contains about 0.25–0.35 weight percent of 2,3-dihydroxypropyl-bis(2-cyanoethyl) amine as well as about 0.70–1.00 weight percent hexamethylene diisocyanate. The binder is in fact a polyether urethane composed of the polymer diol, the polyether triol crosslinker and the aliphatic diisocyanate curative. Also included is 2,3-dihydroxy-bis(2-cyanoethyl) amine, an oxidizer bonding agent which becomes part of the binder matrix. This material strengthens the bond between filler ($NH_4ClO_4$) and binder thereby inhibiting the propagation of tears in the binder. This material also reduces dewetting of the binder from filler thereby increasing both tensile strength and elongation of the propellant.

Copper chromite should constitute about 1.5–3.0 weight percent of the composition and serves as a burning rate accelerator.

The plasticizer of the instant composition should constitute about 2.5–4.5 weight percent and may be (a) an ester of a diol and monocarboxylic acid such as represented by the formula $$CH_3-(CH_2)_n\underset{\underset{O}{\|}}{C}\,O\,R\,O\,\underset{\underset{O}{\|}}{C}\,(CH_2)_m\,CH_3$$

where m and n vary independently and are intergers from 5–9 inclusive and R is alkylene of 6–12 carbon atoms, (b) an ester of a dicarboxylic acid and a monofunctional alcohol such as represented by the formula $$R'\,O\,\underset{\underset{O}{\|}}{C}\,CH_2\,(CH_2)_x\,CH_2\,\underset{\underset{O}{\|}}{C}\,O\,R''$$

where X is an interger between 1 and 6 inclusive and R′ and R″ vary independently and are alkyl of 6–12 carbon atoms or (c) mixtures thereof.

The cure catalyst constitutes 0–0.015 weight percent of the composition and is a metal acetylacetonate. Such acetylacetonates are standard cure catalysts for polyether-urethane propellants but the preferred catalyst is ferric acetylacetonate.

The sole antioxidant of this composition is sulfur, which constitutes about 0.05–0.2 weight percent. When any type of iron is present in the composition, the sulfur not only serves as an antioxidant but serves the purpose of scavenging the excess iron salts through the formation of iron sulfide thereby preventing the iron catalyzed degradation of the urethane linkage in the polymer matrix. The preferred forms of sulfur are flowers of sulfur and colloidal sulfur.

Processing aids, 2,4-pentanedione which constitute 0–0.015 weight percent of the instant composition and liquid silicon oil, such as polydimethyl siloxane, and which constitutes about 0–0.01 weight percent of the instant composition, are also desirable but not essential. The liquid silicon oil acts as a defoaming agent and assists in the casting of the propellant by reducing the "drop" or decrease in propellant height which occurs in rocket chambers filled by the vacuum casting technique. The 2,4-pentanedione acts as a temporary cure retarding agent to extend potlife when used in conjunction with metal acetylacetonates and should be used only when a metal acetylacetonate is used.

The general nature of the invention having been set forth, the following examples are presented as specific illustrations thereof. It will be understood that the invention is not limited to these specific examples but is susceptible to various modifications that will be recognized by one of ordinary skill in the art.

EXAMPLES

Some typical examples of propellant compositions are as follows:

| | Weight % | | |
|---|---|---|---|
| | 1 | 2 | 3 |
| Ammonium Perchlorate | 68.00 | 80.0 | 78.5 |
| Aluminum | 18.20 | 6.0 | 6.0 |
| Poly (1,2-butylene) glycol M.W = 1900–2100 | 5.322 | 5.729 | 7.16 |
| Polypropylene derivative of trimethylolpropane M.W. = 4000–4210 | 1.20 | 1.051 | 0.993 |
| 2,3-dihydroxypropyl-bis-(2-cyanoethyl) amine | 0.30 | 0.30 | 0.30 |
| Hexamethylene diisocyanate | 0.773 | 0.797 | 0.916 |
| Copper Chromite | 2.00 | 1.75 | 2.0 |
| Isodecylpelargonate | 4.08 | 4.243 | 4.016 |
| Ferric Acetylacetonate | 0.015 | 0.015 | 0.005 |
| Flowers of sulfur | 0.10 | 0.10 | 0.10 |
| 2,4-Pentanedione | 0.005 | 0.010 | 0.005 |
| Polydimethyl siloxane | 0.005 | 0.005 | 0.005 |

The propellant compositions of this invention are mixed as follows:

A submix is prepared by blending polydimethyl siloxane, poly (1,2-butylene) glycol, polyoxypropylene derivative of trimethylolpropane and a portion of the isodecylpelargonate in a Cowles dissolver or other high speed mixer. A premix is then made by adding the solid ingredients, sulfur, copper chromite and aluminum, to the prepared submix and blending thoroughly. This premix is then charged into the propellant mixer bowl and the 2,3-dihydroxypropyl-bis-(2-cyanoethyl) amine is added. The oxidizer, ammonium perchlorate, is then added and the mix is thoroughly blended for a period of one half hour at 100° F. At this time a solution of ferric acetylacetonate and hexamethylene dissocyanate is added to the mixed ingredients, which are in the state of a slightly moistened powder at this point of the mix cycle. Further mixing of about 10 minutes is sufficient to fluidize the material. At this point 2,4-pentanedione and the remaining isodecylpelargonate are added, and the mixing proceeds for 20–30 more minutes. At this point the uncured propellant is quite fluid and ready for casting into the rocket chamber. The propellant normally cures in 3–4 days at 110° F. to a shore A hardness of 50–55 but cure time can be decreased to 1–2 days at 135° F.

Obviously, numerous modifications and variations of the present invention are possible in light of the above teachings. It is therefore to be understood that within the scope of the appended claims the invention may be practiced otherwise than as specifically described herein.

What is claimed as new and desired to be secured by Letters Patent of the United States is:

1. A propellant composition, having good thermal cycling ability, consisting essentially of:

(1) 60–85 weight percent ammonium perchlorate;

(2) 2–26 weight percent aluminum;

(3) 2.5–7.5 weight percent poly (1,2-butylene) glycol with a molecular weight of about 1600 to about 2400;

(4) about 1–4 weight percent of a polyoxypropylene derivative of a triol selected from the group consisting of (a) the reaction product of propylene oxide and trimethylolpropane having a molecular weight of between about 3500 and 4700, (b) the reaction product of propylene oxide and hexane triol having a molecular weight of between about 3500 and 4700 and (c) mixtures thereof;

(5) 0.25–0.35 weight percent 2,3-dihydroxypropyl-bis (2-cyanoethyl) amine;

(6) 0.70–1.00 weight percent hexamethylene diisocyanate;

(7) 1.5–3.0 weight percent copper chromite;

(8) 2.5–4.5 weight percent of a carboxylic acid ester selected from the group consisting of $$CH_3-(CH_2)_n\underset{\underset{O}{\|}}{C}\,O\,R\,O\,C\,(CH_2)_m\,CH_3 \qquad (a)$$

wherein n and m vary independently and are intergers from 5–9 inclusive and R is alkylene of 6–12 carbon atoms, $$R'O\,\underset{\underset{O}{\|}}{C}\,CH_2\,(CH_2)_x\,CH_2\,\underset{\underset{O}{\|}}{C}\,O\,R'' \qquad (b)$$

wherein X is an interger between 1 and 6 inclusive and R′ and R″ vary independently and are alkyl of 6–12 carbon atoms and (c) mixtures thereof;

(9) 0–0.20 weight percent of a metal acetylacetonate;

(10) 0.05–0.2 weight percent sulfur;

(11) 0–0.015 weight percent 2,4-pentanedione; and

(12) 0–0.01 weight percent liquid silicon oil, provided that when no metal acetylacetonate is present, no 2,4-pentanedione is present.

2. The propellant composition of claim 1 wherein:

said poly (1,2-butylene) glycol has a molecular weight between about 1900–2100, said polyoxypropylene derivative of a triol is selected from the group consisting of (a) the reaction product of propylene oxide and trimethylolpropane having a molecular weight between about 4000–4210, (b) the reaction product of propylene oxide and hexane triol having a molecular weight of about 4000–4210, and (c) mixtures thereof, said carboxylic acid ester is isodecyl pelargonate, said metal acetylacetonate is ferric acetylacetonate, said sulfur is flowers of sulfur, and said liquid silicon oil is polydimethyl siloxane.

3. The composition of claim 2 wherein (1) ammonium perchlorate constitutes about 68 weight percent,
(2) aluminum constitutes about 18.2 weight percent,
(3) poly (1,2-butylene) glycol constitutes about 5.3 weight percent,
(4) the polyoxypropylene derivative constitutes about 1.2 weight percent,
(5) 2,3-dehydroxypropyl-bis (2-cyanoethyl) amine constitutes about 0.3 weight percent,
(6) hexamethylene diisocyanate constitutes about 0.77 weight percent,
(7) copper chromite constitutes about 2 weight percent,
(8) isodecylpelargonate constitutes about 4.08 weight percent,
(9) ferric acetylacetonate constitutes about 0.015 weight percent,
(10) flowers of sulfur constitute about 0.1 weight percent,
(11) 2,4-pentanedione constitutes about 0.005 weight percent, and
(12) polydimethylsiloxane constitutes about 0.005 weight percent.

4. The composition of claim 2 wherein (1) ammonium perchlorate constitutes about 80 weight percent,
(2) aluminum constitutes about 6 weight percent,
(3) poly (1,2-butylene) glycol constitutes about 5.729 weight percent,
(4) the polyoxypropylene derivative constitutes about 1.051 weight percent,
(5) 2,3-dihydroxypropyl-bis(2-cyanoethyl) amine constitutes about 0.3 weight percent,
(6) hexamethylene diisocyanate constitutes about 0.797 weight percent,
(7) copper chromite constitutes about 1.75 weight percent,
(8) isodecylpelargonate constitutes about 4.243 weight percent,
(9) ferric acetylacetonate constitutes about 0.015 weight percent,
(10) flowers of sulfur constitute about 0.1 weight percent,
(11) 2,4-pentanedione constitutes about 0.010 weight percent and
(12) polydimethylsiloxane constitutes about 0.005 weight percent.

5. The composition of claim 2 wherein (1) ammonium perchlorate constitutes about 78.5 weight percent,
(2) aluminum constitutes about 6 weight percent,
(3) poly (1,2-butylene) glycol constitutes about 7.16 weight percent,
(4) the polyoxypropylene derivative constitutes about 0.993 weight percent,
(5) 2,3-dihydroxypropyl-bis (2-cyanoethyl) amine constitutes about 0.3 weight percent,
(6) hexamethylene diisocyanate constitutes about 0.916 weight percent,
(7) copper chromite constitutes about 2.0 weight percent,
(8) isodecylpelargonate constitutes about 4.016 weight percent,
(9) ferric acetylacetonate constitutes about 0.005 weight percent,
(10) flowers of sulfur constitute about 0.1 weight percent,
(11) 2,4-pentanedione constitutes about 0.005 weight percent, and
(12) polydimethylsiloxane constitutes about 0.005 weight percent.

6. The composition of claim 1 in the cured state.
7. The composition of claim 2 in the cured state.
8. The composition of claim 3 in the cured state.
9. The composition of claim 4 in the cured state.
10. The composition of claim 5 in the cured state.

* * * * *